US007664453B2

(12) United States Patent
Morishita

(10) Patent No.: US 7,664,453 B2
(45) Date of Patent: Feb. 16, 2010

(54) CLEANING DEVICE AND IMAGE FORMING APPARATUS

(75) Inventor: Hiroki Morishita, Osaka (JP)

(73) Assignee: Kyocera Mita Corporation (JP)

( * ) Notice: Subject to any disclaimer, the term of this patent is extended or adjusted under 35 U.S.C. 154(b) by 143 days.

(21) Appl. No.: 11/975,783

(22) Filed: Oct. 22, 2007

(65) Prior Publication Data

US 2008/0101833 A1 May 1, 2008

(30) Foreign Application Priority Data

Oct. 26, 2006 (JP) ..... 2006-291013

(51) Int. Cl.
*G03G 21/00* (2006.01)

(52) U.S. Cl. ..... 399/349; 399/351

(58) Field of Classification Search ..... 399/349, 399/343, 351, 358; 15/256.5, 256.51, 256.52
See application file for complete search history.

(56) References Cited

U.S. PATENT DOCUMENTS 4,111,545 A * 9/1978 Meltzer ..... 399/351
4,427,289 A * 1/1984 Oda ..... 15/256.51 X
4,974,030 A * 11/1990 Tokunaga et al. ..... 399/349 X
5,289,249 A * 2/1994 Yamamoto et al. ..... 399/359
2003/0219289 A1* 11/2003 Kawahara et al. ..... 399/349
2006/0024099 A1* 2/2006 Suzuki et al. ..... 399/349
2006/0204296 A1* 9/2006 Maruyama et al. ..... 399/349

FOREIGN PATENT DOCUMENTS

JP 63-254483 A * 10/1988
JP 2005-148609 6/2005
JP 2006-201333 8/2006

* cited by examiner

*Primary Examiner*—Sophia S Chen
(74) *Attorney, Agent, or Firm*—Gerald E. Hespos; Anthony J. Casella

(57) ABSTRACT

A cleaning device includes: a housing; a cleaning roller provided in the housing and operable to come into contact with a photosensitive drum; a cleaning blade operable to come into contact with a surface of the photosensitive drum at a position lower than a nip position between the cleaning roller and the photosensitive drum; and a toner guide plate disposed below the cleaning roller. The toner guide plate includes: a blade proximity portion in proximity to the cleaning blade; and a toner guide portion extending along an outer surface of the cleaning roller, spaced away from the outer surface of the cleaning roller by a predetermined gap. In the cleaning device, the surface of the photosensitive drum can be polished as required.

13 Claims, 8 Drawing Sheets

CLEANING DEVICE AND IMAGE FORMING APPARATUS

BACKGROUND OF THE INVENTION

1. Field of the Invention

The present invention relates to a cleaning device, and an image forming apparatus incorporated with the cleaning device.

2. Description of the Related Art

Heretofore, an amorphous silicon photosensitive drum has been used in an image forming apparatus. Amorphous silicon to be used as a material for the amorphous silicon photosensitive drum has a relatively large hardness and a long useful life, but has a disadvantage that an electric charge is likely to leak during a long-term use, thereby deteriorating a toner image. In view of the above, there is known a cleaning device equipped with a cleaning roller i.e. a contact roller. Specifically, the cleaning roller is constantly pressingly contacted with the surface of the photosensitive drum to thereby polish the surface of the photosensitive drum. The cleaning roller is made of a foaming synthetic rubber e.g. EPDM (ethylene propylene diene terpolymer).

Japanese Unexamined Patent Publication No. 2006-201333 (D1) discloses an image forming apparatus, wherein a sheet transport path extends substantially horizontally in a tangential direction with respect to a top of a photosensitive drum. In the apparatus disclosed in D1, a cleaning roller is pressingly contacted with the surface of the photosensitive drum at a vertically mid point of the cleaning roller and a vertically mid point of the photosensitive drum substantially horizontally. The photosensitive drum and the cleaning roller are each rotated in a downward direction at a pressing contact position i.e. a nip position between the photosensitive drum and the cleaning roller. With this arrangement, an upper end of a vertically extending cleaning blade is pressingly contacted with the photosensitive drum at a position lower than the nip position i.e. downstream with respect to the rotating direction of the drum. A cleaning device having the above arrangement is e.g. disclosed in Japanese Unexamined Patent Publication No. 2005-148609 (D2).

Although D2 does not disclose such an arrangement, a cleaning device generally has a housing, and a cleaning roller is provided in the housing. Also, a cleaning blade is provided in the housing. If a function of collecting toner scraped from the surface of the photosensitive drum is required, a spiral roller for collecting the toner is also provided in the housing.

In the cleaning device, toner added with a polishing agent such as titanium oxide is used to polish the surface of the photosensitive drum. Primary part of the toner scraped from the surface of the photosensitive drum by the cleaning roller and the cleaning blade is allowed to fall onto a bottom surface in the housing. On the other hand, the toner that has been adhered to the outer surface of the cleaning roller is carried to the nip position between the photosensitive drum and the cleaning roller by rotation of the cleaning roller, and the surface of the photosensitive drum is polished at the nip position by the toner adhered to the outer surface of the cleaning roller. However, since the amount of toner that has been adhered to the outer surface of the cleaning roller is meager, the surface of the photosensitive drum may not be sufficiently polished as required.

SUMMARY OF THE INVENTION

In view of the above, an object of the invention is to provide a cleaning device which has solved the above problems residing in the prior art.

Another object of the invention is to provide a cleaning device that enables to polish the surface of a photosensitive drum as required, as well as an image forming apparatus incorporated with the cleaning device.

An aspect of the invention provides a cleaning device including: a housing; a cleaning roller provided in the housing and operable to come into contact with a photosensitive drum; a cleaning blade operable to come into contact with a surface of the photosensitive drum at a position lower than a nip position between the cleaning roller and the photosensitive drum; and a toner guide plate disposed below the cleaning roller, wherein the toner guide plate includes: a blade proximity portion in proximity to the cleaning blade; and a toner guide portion extending along an outer surface of the cleaning roller, spaced away from the outer surface of the cleaning roller by a predetermined gap.

These and other objects, features and advantages of the present invention will become more apparent upon reading the following detailed description along with the accompanying drawings.

DETAILED DESCRIPTION OF THE PREFERRED EMBODIMENTS

Figure 1:
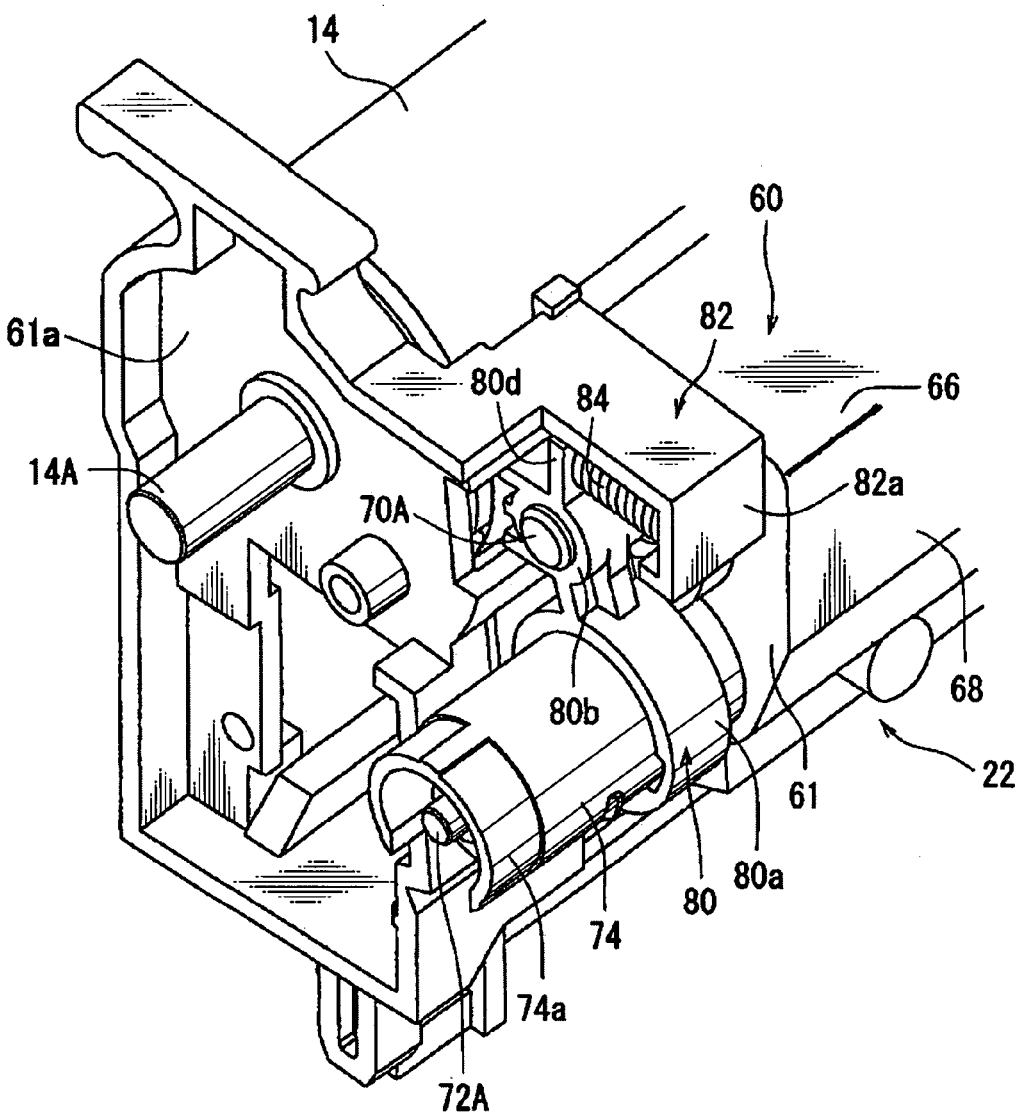
FIG. 1 is a perspective view partly showing a longitudinal end of a cleaning device embodying the invention.

In the following, an embodiment of the invention is described in detail referring to the accompanying drawings.

Before a cleaning device embodying the invention is described, the entire construction of a tandem color printer (hereinafter, simply called as a "printer") 2, as an example of an image forming apparatus incorporated with the cleaning device, is described referring to FIG. 8.

The printer 2 has a main body 4 as a substantially rectangular parallelepiped image forming apparatus main body. A magenta processing unit GM, a cyan processing unit 8C, a yellow processing unit 10Y, and a black processing unit 12BK are arranged in the printer main body 4. The processing units 6M, 8C, 10Y, and 12BK are arranged in this order from upstream in a sheet transport direction. Each of the processing units 6M, 8C, 10Y, and 12BK includes imaging elements such as a photosensitive drum 14, a charger 16, a developer 18, a primary transfer roller 20, and a cleaning device 22. An amorphous silicon photosensitive member is used as the photosensitive drum 14. In FIG. 8, the reference numerals concerning the processing units are attached merely to the imaging elements of the magenta processing unit 6M for simplifying the illustration. In this embodiment, the processing units 6M, 8C, 10Y, and 12BK are arranged side by side substantially in a horizontal direction in the aforementioned order substantially linearly from right to left in FIG. 8.

A laser scanning unit LSU is provided below the processing units 6M, 8C, 10Y, and 12BK. The laser scanning unit LSU successively irradiates a laser beam for scanning onto the surfaces of the photosensitive drums 14 of the processing units 6M, 8C, 10Y, and 12BK based on image information.

An intermediate transfer belt mechanism 24 is provided above the processing units 6M, 8C, 10Y, and 12BK. The intermediate transfer belt mechanism 24 includes a drive roller 26, a driven roller 28, and an intermediate transfer belt 30 wound around the drive roller 26 and the driven roller 28. The intermediate transfer belt 30 extends substantially horizontally in transverse directions of FIG. 8 between the drive roller 26 and the driven roller 28.

Toner replenishing containers 18M, 18C, 18Y, and 18BK are mounted at positions above the intermediate transfer belt 30 in correspondence to the processing units 6M, 6C, 10Y, and 12BK, respectively. Each of the toner replenishing containers 18M, 18C, 18Y, and 18BK is adapted to replenish toner of a corresponding color to the corresponding developer 18 via an unillustrated transport path and an unillustrated transporter.

In each of the processing units 6M, 8C, 10Y, and 12BK, the primary transfer roller 20 is pressingly contacted with the photosensitive drums 14 from above by way of a lower running area of the intermediate transfer belt 30.

Figure 8:
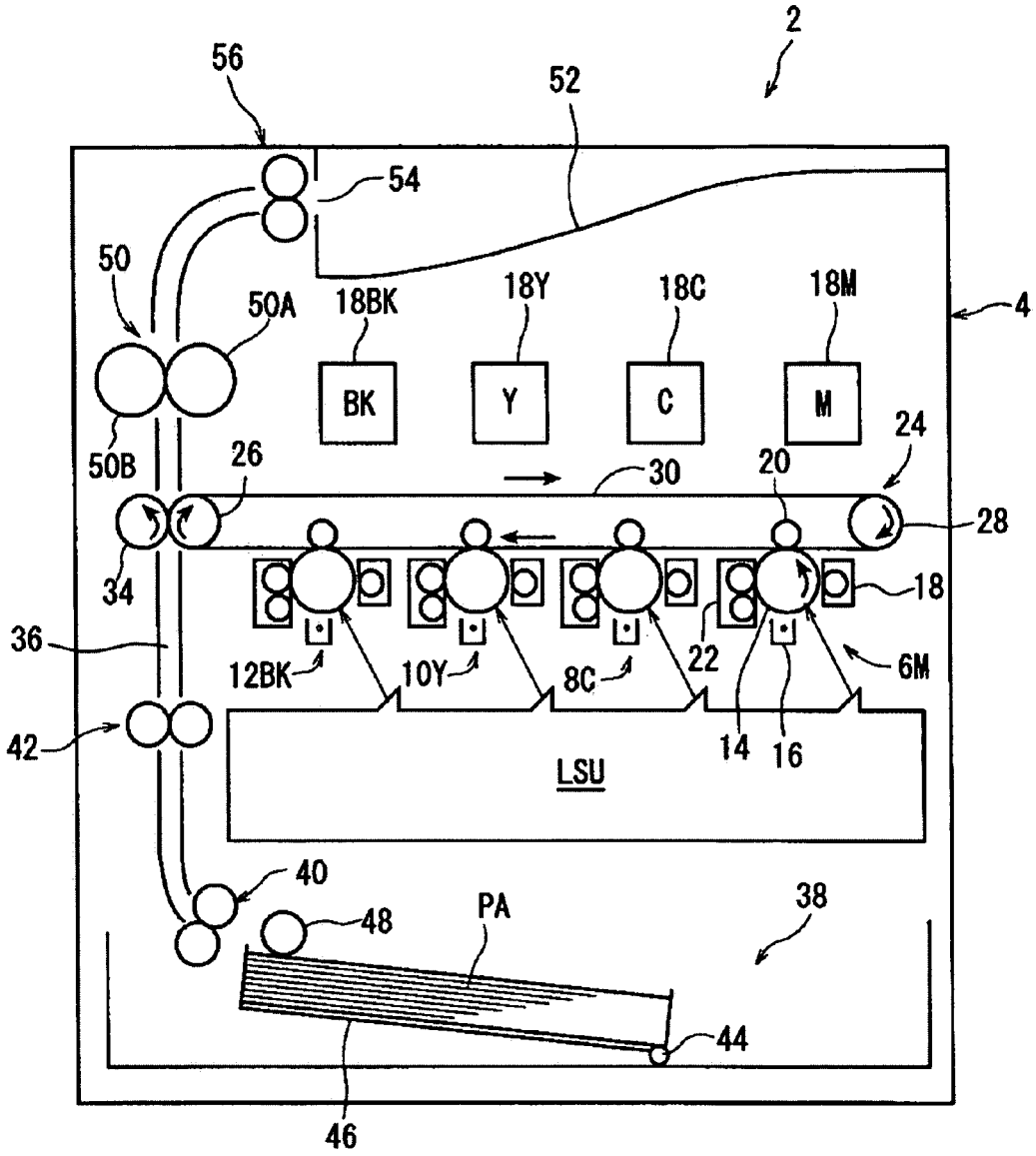
FIG. 8 is a schematic diagram of a tandem color printer incorporated with the cleaning device shown in FIG. 1.

A secondary transfer roller 34 is arranged on the left of the drive roller 26 in FIG. 8. The secondary transfer roller 34 is pressingly contacted with the drive roller 26 in a rightward direction in FIG. 8 via the intermediate transfer belt 30. The drive roller 26 is rotated clockwise in FIG. 8. Accordingly, the intermediate transfer belt 30, the primary transfer rollers 20, and the driven roller 28 are also rotated clockwise.

A transport path 36 is formed on a left side of the intermediate transfer belt mechanism 24 in FIG. 8 to transport a sheet PA as a recording medium. The transport path 36 extends substantially vertically along an inner left side wall of the printer main body 4 in FIG. 8. A nip position between the drive roller 26 of the intermediate transfer belt mechanism 24, and the secondary transfer roller 34 is defined at an appropriate position on the transport path 36.

A sheet cassette 38 is communicated with a lower end of the printer main body 4. The sheet cassette 38 is connected to an upstream end area of the transport path 36. A separation roller pair 40 and a registration roller pair 42 are provided upstream with respect to the nip position between the drive roller 26 and the secondary transfer roller 34. The separation roller pair 40 and the registration roller pair 42 are arranged in this order from upstream toward downstream along the transport path 36.

A bottom plate 46, a compression coil spring (not shown), and other parts are arranged at respective appropriate positions in the sheet cassette 38. The bottom plate 46 is a sheet setting plate whose one end is pivotally supported about an axis of a rod 44. The compression coil spring is adapted to press the other end of the bottom plate 46 upward. An upper surface on a lead end of the uppermost sheet PA of the sheets stacked on the bottom plate 46 is pressingly contacted with a pickup roller 48 disposed in the printer main body 4.

A fixing device 50 is provided downstream with respect to the nip position between the drive roller 26 and the secondary transfer roller 34 in the transport path 36. The fixing device 50 has a heater roller 50A and a pressure roller 50B.

A sheet discharge tray 52 is formed at an upper part of the printer main body 4. In FIG. 8, a left end portion of the sheet discharge tray 52 extends substantially vertically downward from an upper surface of the printer main body 4, and a bottom portion of the sheet discharge tray 52 extends from a lower end of the left end portion of the sheet discharge tray 52 rightward upwardly in FIG. 8 to the upper surface of the printer main body 4. A discharge port 54 through which a sheet PA is discharged onto the sheet discharge tray 52 is formed at the left end portion of the sheet discharge tray 52. An upper end of the transport path 36 is bent in such a direction as to extend substantially horizontally toward the discharge port 54 of the sheet discharge tray 52. A discharge roller pair 56 is provided immediately upstream of the discharge port 54.

A printing operation to be executed by the printer 2 having the above arrangement is briefly described referring to FIG. 8. In performing a printing operation, electrostatic latent images are respectively formed in the processing units 6M, 8C, 10Y, and 12BK by allowing the surfaces of the photosensitive drums 14 which are uniformly charged by the respective corresponding chargers 16 to be exposed to laser light emitted from the laser scanning unit LSU. The electrostatic latent images are developed into toner images by the respective corresponding developers 18. The toner images are then transferred to the intermediate transfer belt 30 by the respective corresponding primary transfer rollers 20. At this time, the toner images are successively superimposed one over the other onto the intermediate transfer belt 30 from the toner image formed in the upstream most processing unit 6M in the predetermined order. The superimposed color toner images transferred to the intermediate transfer belt 30 are then transferred onto a sheet PA passing through the nip position between the drive roller 26 and the secondary transfer roller 34. The superimposed color toner images transferred onto the sheet PA are thermally fixed on the sheet PA while the sheet PA passes through the fixing device 50. After the toner image fixation, the sheet PA is discharged onto the sheet discharge tray 52 by the discharge roller pair 56, with its surface carrying the transferred toner images facing downward.

Next, the cleaning devices 22 provided in the printer 2 are described. Since the cleaning devices 22 provided in the processing units 6M, 8C, 10Y, and 12BK are substantially identical to each other in construction, the cleaning device 22 of the magenta processing unit 6M is described as a representative of the cleaning devices 22.

Figure 2:
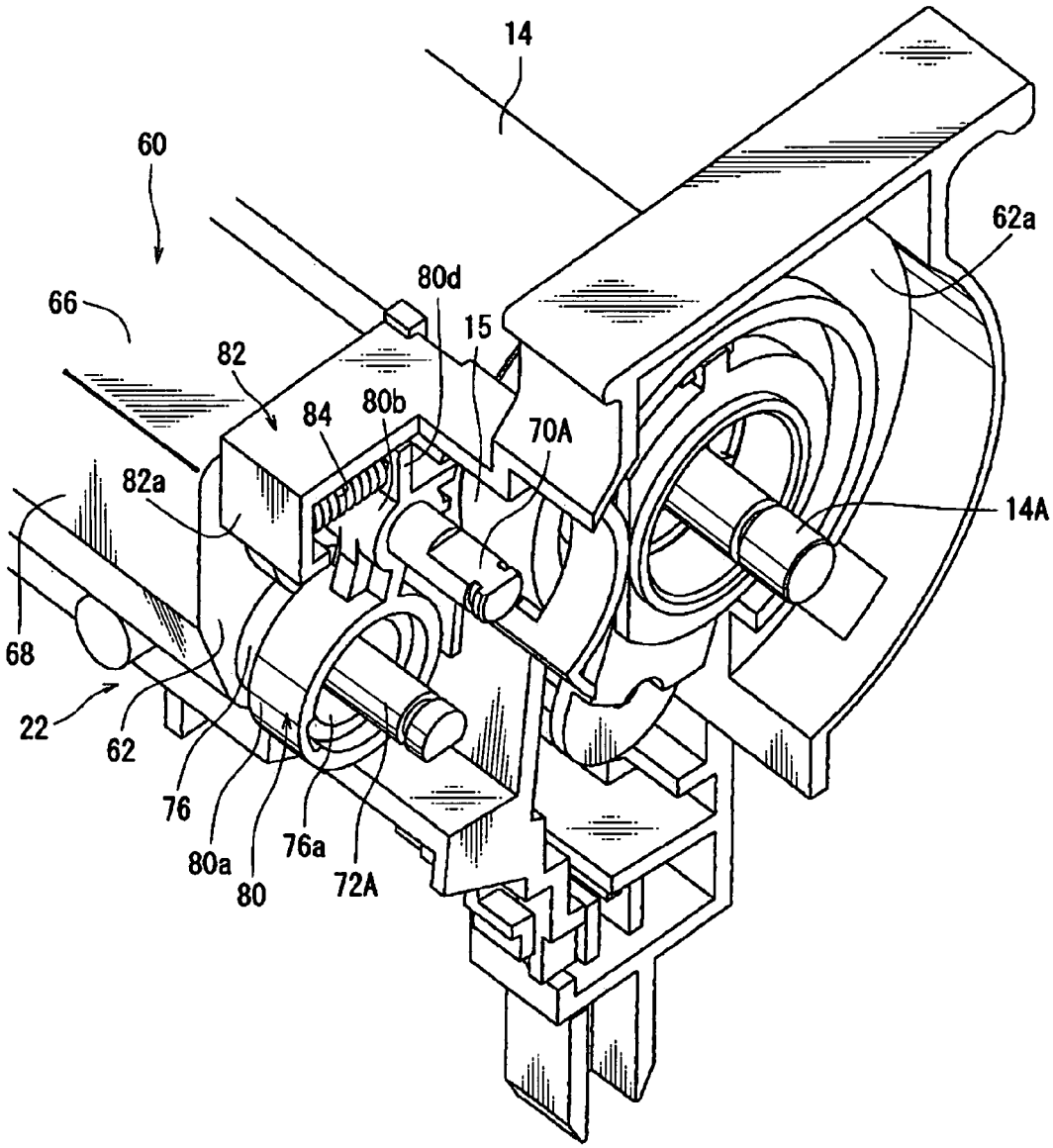
FIG. 2 is a perspective view partly showing the longitudinal other end of the cleaning device shown in FIG. 1.
Figure 3:
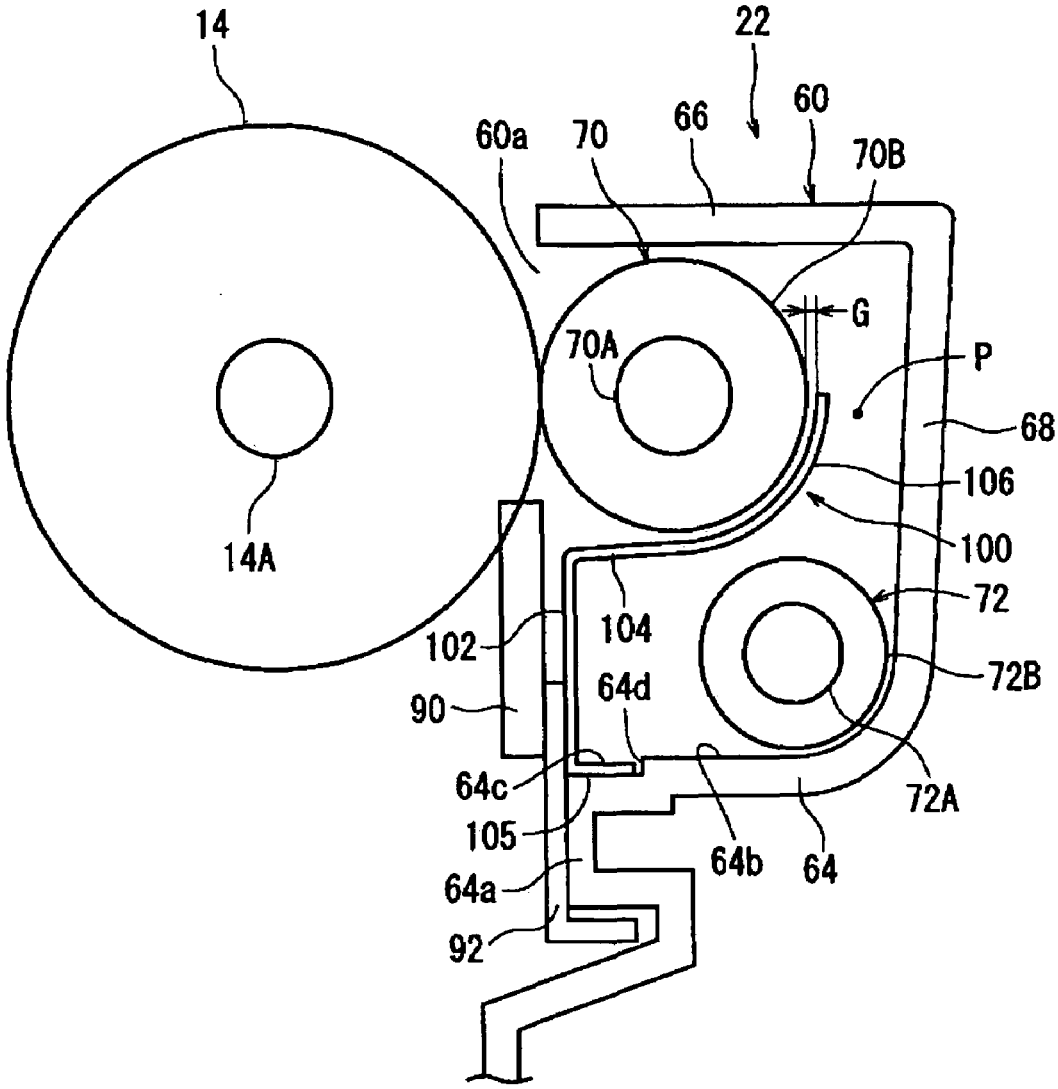
FIG. 3 is a schematic diagram for describing a positional relation of parts of the cleaning device shown in FIG. 1.

As shown in FIGS. 1 through 3, the cleaning device 22 includes a housing 60. The housing 60 has a pair of a side wall 61 (see FIG. 1) and a side wall 62 (see FIG. 2), a bottom wall 64, a top wall 66, and an end wall 68. The side wall 61 and the side wall 62 are disposed away from each other in the axial direction of the photosensitive drum 14. The bottom wall 64 extends between a lower end of the side wall 61 and a lower end of the side wall 62 in the axial direction of the photosensitive drum 14 to connect the side wall 61 and the side wall 62. The top wall 66 extends between an upper end of the side wall 61 and an upper end of the side wall 62 in the axial direction of the photosensitive drum 14 to connect to the side wall 61 and the side wall 62. The end wall 68 extends between an end portion of the side wall 61 and an end portion of the side wall 62 in the axial direction of the photosensitive drum 14. The end wall 68 is continued to an end portion of the bottom wall 64 and an end portion of the top wall 66.

An opening 60*a* is formed in the housing 60 at a position opposing to the end wall 68. The opening 60*a* is defined by the side wall 61, the side wall 62, the bottom wall 64, and the other end portion of the top wall 66. As shown in FIG. 3, the photosensitive drum 14 is disposed in a state that an outer surface of the photosensitive drum 14 is located within the opening 60*a*.

The housing 60 includes an extension wall 61*a* continued to the side wall 61, and an extension wall 62*a* continued to the side wall 62. The extension walls 61*a* and 62*a* extend from the side walls 61 and 62 in a direction opposite to the end wall 68, respectively. The extension walls 61*a* and 62*a* are opposed to each other in the axial direction of the photosensitive drum 14 by a distance larger than the distance between the side walls 61 and 62.

The photosensitive drum 14 is arranged in a space between the extension walls 61*a* and 62*a*. A shaft 14A of the photosensitive drum 14, whose one end extends from one axial end of the photosensitive drum 14, is rotatably supported on the extension wall 62*a*. The other end of the shaft 14A extending from the other axial end of the photosensitive drum 14 is rotatably supported on the side wall 62*a* via an unillustrated bearing. The side walls 61 and 62 constituting the housing 60 are disposed away from each other by a certain distance in the axial direction of the photosensitive drum 14. The charger 16 (see FIG. 8) is supported between a lower end of the extension wall 61*a* and a lower end of the extension wall 62*a*.

Figure 4:
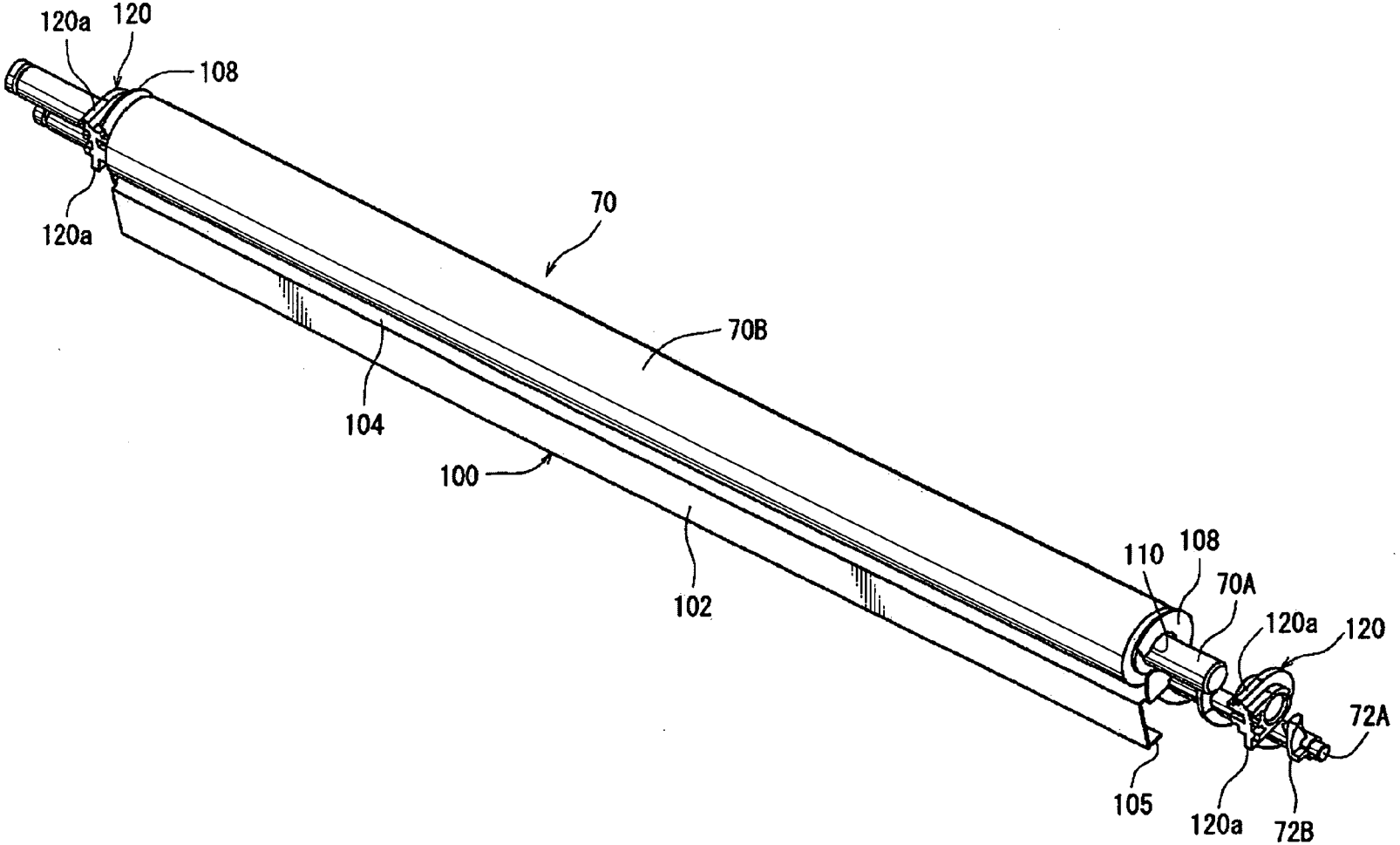
FIG. 4 is a partially exploded perspective view showing a cleaning roller mounted with a toner guide plate, along with a spiral roller.
Figure 5:
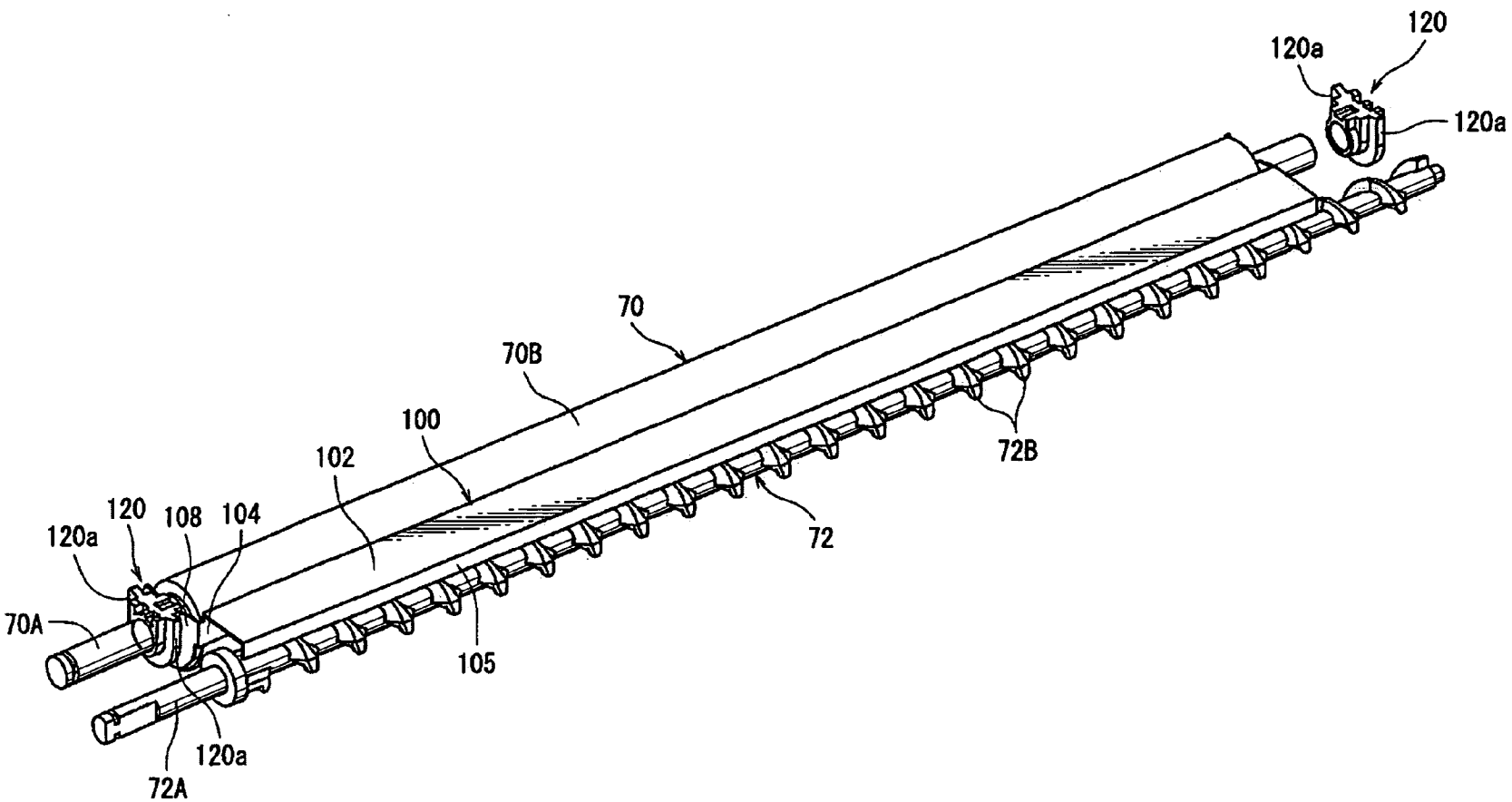
FIG. 5 is a perspective view of the cleaning roller and the spiral roller shown in FIG. 4, viewed from a different angle.

As shown in FIGS. 3 through 5, a cleaning roller 70 and a spiral roller 72 are arranged in the housing 60. The cleaning roller 70 has a shaft 70A, and a roller member 70B fixedly mounted on an outer surface of the shaft 70A to be integrally rotatable with the shaft 70A. The roller member 70B is made of a foaming synthetic rubber e.g. EPDM. The spiral roller 72 has a shaft 72A, and spiral segments 72B integrally formed with the shaft 72A. The spiral segments 72B are spirally formed on an outer surface of the shaft 72A.

As shown in FIGS. 1 and 2, cylindrical portions 74 and 76 are formed at lower ends of the side walls 61 and 62 of the housing 60 at positions closer to the end wall 68, respectively. The cylindrical portions 74 and 76 each extends outwardly in the axial direction of the photosensitive drum 14. The cylindrical portions 74 and 76 have outer diameters identical to each other, and are coaxially aligned with each other. One end, specifically, a left end in FIG. 5, of the shaft 72A of the spiral roller 72 is rotatably supported on an unillustrated bearing disposed in a central part of an unillustrated cover member. The cover member is detachably attached to an outer surface of an opening end 74*a* of the cylindrical portion 74. The cylindrical portion 74 has an inner diameter capable of defining a gap with respect to an outer surface of the spiral segments 72B.

The other end, specifically, a right end in FIG. 5, of the shaft 72A of the spiral roller 72 is rotatably supported on an unillustrated bearing which is detachably mounted on an inner surface of an opening end 76*a* of the cylindrical portion 76. The shaft 72A of the spiral roller 72 is substantially coaxially aligned with the cylindrical portions 74 and 76.

Figure 7:
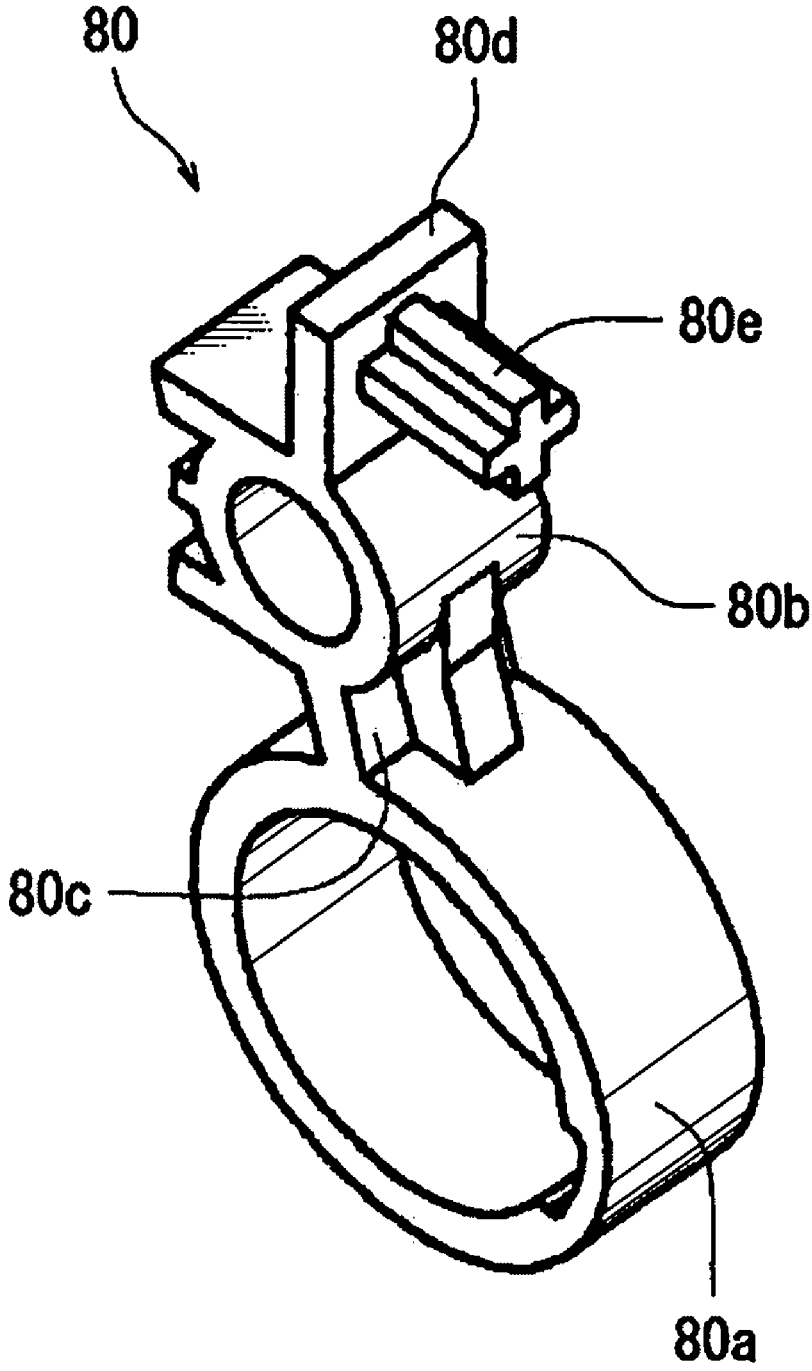
FIG. 7 is a perspective view of an arm member shown in FIG. 1.

A pair of arm members 80 are pivotally supported on the cylindrical portions 74 and 76, respectively. As shown in FIG. 7, the arm members 80 each includes a large-diametrical portion 80*a*, a small-diametrical portion 80*b*, and a planar-shaped connecting portion 80*c* for integrally connecting the large-diametrical portion 80*a* and the small-diametrical portion 80*b*. The small-diametrical portion 80*b* is continued to an upper end of the connecting portion 80*c*. The large-diametrical portion 80*a* is continued to a lower end of the connecting portion 80*c*. The large-diametrical portion 80*a* and the small-diametrical portion 80*b* are axially aligned parallel to each other. The axial widths of the large-diametrical portion 80*a* and the small-diametrical portion 80*b* are identical to each other. One axial surface of the large-diametrical portion 80*a* and corresponding one axial surface of the small-diametrical portion 80*b* are located on the same flat plane substantially orthogonal to the axial lines of the large-diametrical portion 80*a* and the small-diametrical portion 80*b*, and the other axial surface of the large-diametrical portion 80*a* and the corresponding other axial surface of the small-diametrical portion 80*b* are located on the same flat plane substantially orthogonal to the axial lines of the large-diametrical portion 80*a* and the small-diametrical portion 80*b*. The connecting portion 80*c* has an axial thickness, with an imaginary line (not shown) passing the centers of axes of the large-diametrical portion 80*a* and the small-diametrical portion 80*b* being defined as a centerline. The connecting portion 80*c* extends in the direction of the imaginary line. The axial width of the connecting portion 80*c* is the same as the axial widths of the large-diametrical portion 80*a* and the small-diametrical portion 80*b*.

A plate-shaped flange 80*d* extends upwardly from the top of an outer surface of the small-diametrical portion 80*b*. The flange 80*d* is tilted toward one circumferential direction with respect to the imaginary line, as the flange 80*d* extends away from the outer surface of the small-diametrical portion 80*b*. A positioning rod 80*e* is arranged on a surface of the flange 80*d* away from the imaginary line, and extends straightforwardly from the middle of the rectangular surface of the flange 80*d*.

As shown in FIG. 1, the large-diametrical portion 80*a* of one of the arm members 80 is mounted on the outer surface of the cylindrical portion 74 of the side wall 61. The one arm member 80 is pivotally supported on the cylindrical portion 74. As shown in FIG. 2, the large-diametrical portion 80*a* of the other arm member 80 is mounted on the outer surface of the cylindrical portion 76 of the sidewall 62. The other arm member 80 is pivotally supported on the cylindrical portion 76.

One end of the shaft 70A of the cleaning roller 70 (see FIG. 5) is rotatably supported on the small-diametrical portion 80*b* of the one arm member 80. The other end of the shaft 70A of the cleaning roller 70 is rotatably supported on the small-diametrical portion 80*b* of the other arm member 80. An unillustrated through-hole is formed in the side wall 61 of the housing 60, and the one end of the shaft 70A of the cleaning roller 70 extends through the through-hole. Likewise, an unillustrated through-hole is formed in the side wall 62 of the housing 60, and the other end of the shaft 70A of the cleaning roller 70 extends through the through-hole.

As shown in FIGS. 1 and 2, spring receptacles 82 and 82 are provided at the side walls 61 and 62 of the housing 60, respectively. The spring receptacles 82 and 82 are provided at upper ends of the side walls 61 and 62 at axially outer positions of the housing 60, respectively. The spring receptacles 82 each has a peripheral wall 82*a* opposing to the flange 80*d* of the corresponding arm member 80 spaced away therefrom.

A compression coil spring 84 is provided between the flange 80*d* of each of the arm members 80, and the corresponding peripheral wall 82*a*. One end of the compression coil spring 84 is mounted on the positioning rod 80*e* (see FIG. 7) of the flange 80*d* of the corresponding arm member 80. The other end of the compression coil spring 84 is mounted on an unillustrated positioning projection formed on the corresponding peripheral wall 82*a*.

The compression coil spring 84 urges the corresponding arm member 80 in such a direction that the roller member 70B of the cleaning roller 70 is pressed against the photosensitive drum 14. Specifically, as shown in FIG. 3, by the compression coil spring 84, the outer surface of the roller member 70B of the cleaning roller 70 is pressingly contacted with the outer surface of the photosensitive drum 14 at a vertically mid point of the photosensitive drum 14 and a vertically mid point of the roller member 70B, horizontally along an imaginary line connecting the center of axis of the shaft 14A and the center of axis of the shaft 70A, within an upper region of the opening 60*a* of the housing 60. In other words, the roller member 70B of the cleaning roller 70 is pressingly contacted with the photosensitive drum 14 through the opening 60*a* of the housing 60. The shaft 70A of the cleaning roller 70 and the shaft 72A of the spiral roller 72 are aligned parallel to the shaft 14A of the photosensitive drum 14.

A cleaning blade 90 is provided in the housing 60. The cleaning blade 90 substantially vertically extends in a region below the opening 60*a*. An upper end of the cleaning blade 90 is pressingly contacted with the surface of the photosensitive drum 14. Specifically, the bottom wall 64 of the housing 60 includes an extension wall 64*a* extending substantially downwardly from a position corresponding to a lower perimeter of the opening 60*a*. A blade support plate 92 made of a sheet metal is fixed to the extension wall 64*a* in a state that a lower end inner surface of the blade support plate 92 overlaps an outer surface of the extension wall 64*a*. On the other hand, an upper end of the blade support plate 92 extends to a position above an inner surface i.e. an upper surface 64*b* of the bottom wall 64 of the housing 60. A lower end inner surface of the cleaning blade 90 is fixed to an upper end outer surface of the blade support plate 92. In other words, the cleaning blade 90 is mounted to the housing 60 via the blade support plate 92. The blade support plate 92 linearly extends in the axial direction of the photosensitive drum 14, and has a certain height.

The spiral roller 72 is adapted to collect toner residues scraped from the surface of the photosensitive drum 14. As shown in FIG. 3, the spiral roller 72 is arranged below the cleaning roller 70. The shaft 72A of the spiral roller 72 is arranged at a position closer to the end wall 68 of the housing 60 than the shaft 70A of the cleaning roller 70. The spiral segments 72B of the spiral roller 72 are formed with a certain gap with respect to an arc portion of the housing 60 joining the bottom wall 64 and the end wall 68. A horizontal gap between the outer surface of the spiral segments 72B of the spiral roller 72 and the end wall 68 is smaller than a horizontal gap between the outer surface of the roller member 70B of the cleaning roller 70, and the end wall 68.

Figure 6:
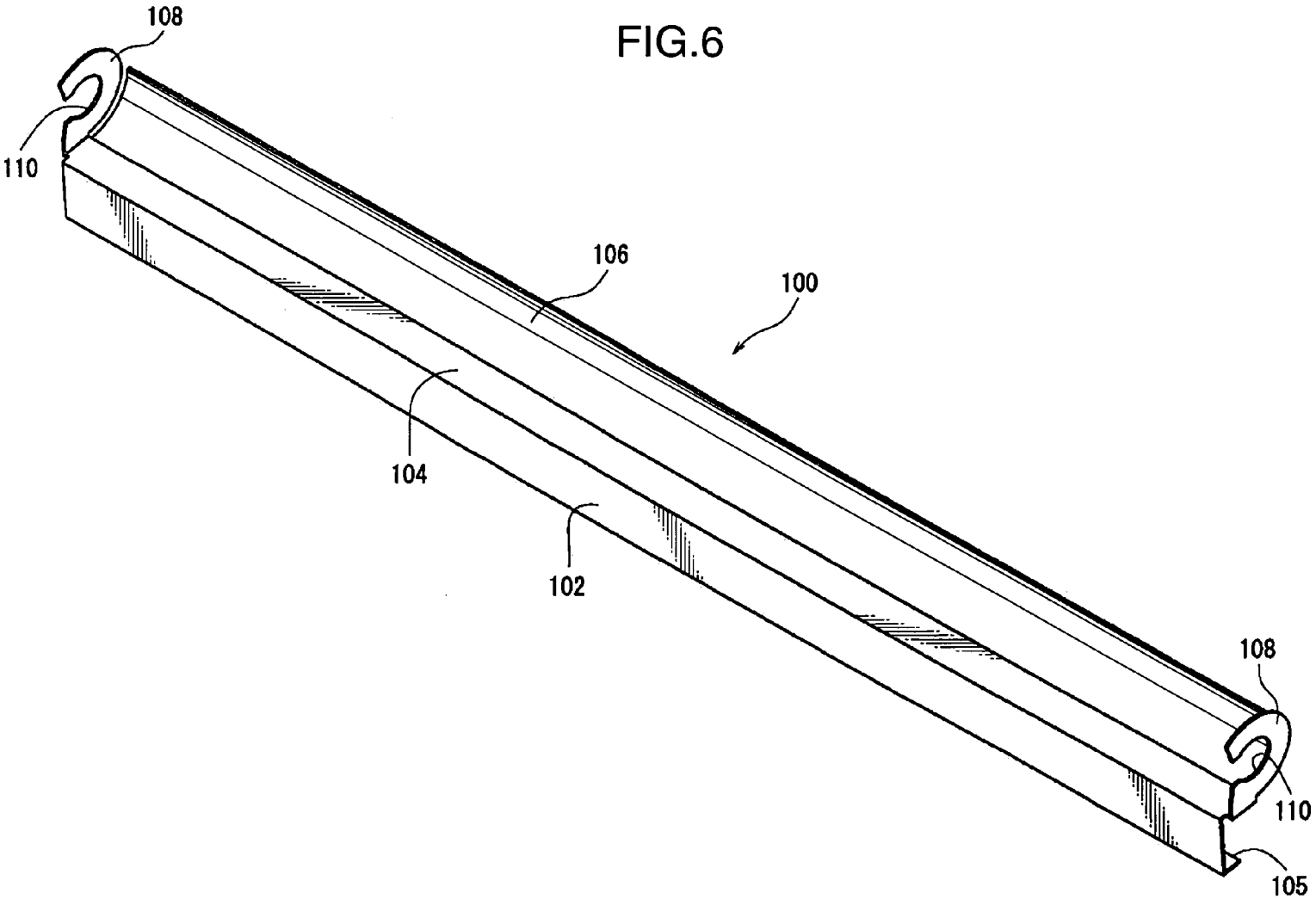
FIG. 6 is a perspective view of the toner guide plate.

As shown in FIGS. 3 and 6, the cleaning device 22 has a toner guide plate 100. The toner guide plate 100 is made of a metal e.g. stainless (SUS), or a synthetic resin. The toner guide plate 100 includes a base portion 102, an upper flange 104, a lower flange 105, a toner guide portion 106, and a pair of support flanges 108.

The base portion 102 has an elongated shape extending in a certain direction, with a substantially fixed height in a vertical direction. The base portion 102 linearly extends in the axial direction of the photosensitive drum 14 while being mounted in the housing 60. The upper flange 104 extends from an upper end of the base portion 102 toward the end wall 68 of the housing 60. In this embodiment, the upper flange 104 extends in a direction substantially orthogonal to the base portion 102.

The lower flange 105 extends from a lower end of the base portion 102 toward the end wall 68 of the housing 60. In this embodiment, the lower flange 105 extends in a direction substantially orthogonal to the base portion 102. The lower flange 105 has a lateral width smaller than that of the upper flange 104.

The toner guide portion 106 has an arc shape in cross-section, and is oriented upwardly from a lead end of the upper flange 104. Both of the support flanges 108 are identical to each other in shape and size. The support flanges 108 extend upright from longitudinal both ends of the upper flange 104, respectively. Each of the support flanges 108 extends in an arc shape in the same direction as the toner guide portion 106. Each of the support flanges 108 is formed with an arc-shaped support hole 110 opening toward the photosensitive drum 14. Each of the support holes 110 has an inner diameter slightly larger than an outer diameter of the shaft 70A of the cleaning roller 70, and has a cross-sectional arc-shape corresponding to a semicircle or more than the semicircle. The support flanges 108 define axial both ends of the photosensitive drum 14 in the longitudinal direction when the photosensitive drum 14 is mounted relative to the housing 60, in other words, the support flanges 108 define axial both ends of the toner guide plate 100 in the longitudinal direction.

As shown in FIG. 4, the shaft 70A of the cleaning roller 70 extends through the support holes 110 of the support flanges 108. The shaft 70A is rotatably supported on the support flanges 108. The shaft 70A is detachably attached to the support flanges 108.

Collar members 120 are respectively mounted on the support flanges 108 at axially outer positions of the shaft 70A to be pivotable relative to the shaft 70A. Each of the collar members 120 has a rib 120*a* extending on an outer surface of the collar member 120 in such a manner that both ends of the rib 120*a* are opposed to each other with respect to the center of axis of the collar member 120. The rib 120*a* extends parallel to a tangential direction of the collar member 120. The arm member 80 is positioned at an axially outer position of the collar member 120 in such a manner that an axial movement of the arm member 80 is substantially restricted. The rib 120*a* of the collar member 120 is slidably engaged in an unillustrated groove formed in a corresponding position of the housing 60 in such a manner that an axial movement of the rib 120*a* is restricted. The moving direction of the rib 120*a* coincides with the pressing direction of the compression coil spring 84. With the above arrangement, the toner guide plate 100 is positioned at a certain axial position.

As shown in FIG. 3, the toner guide plate 100 is cooperatively supported by the blade support plate 92 and the housing 60. Pivotal movement of the toner guide plate 100 is substantially restricted by fixedly mounting a lower end of the toner guide plate 100 to the housing 60. The lower end of the toner guide plate 100 is supported by the inner surface of the blade support plate 92 and the bottom wall 64 of the housing 60. Specifically, the inner surface 64*b* of the bottom wall 64 includes a bottom portion 64*c* having a bottom surface lower than the inner surface 64*b*. The bottom portion 64*c* extends in the longitudinal direction of the housing 60, with a fixed width of the bottom portion 64*c* extending from the lower end of the opening 60*a* toward the end wall 68, and a certain depth. The bottom portion 64*c* extends between the side wall 61 and the side wall 62. A stepped portion 64*d* is formed between the inner surface 64*b* and the bottom portion 64*c* of the bottom wall 64.

The lower end of the toner guide plate 100 is constituted of the lower flange 105 and a lower end of the base portion 102. The lower flange 105 is fixed to the bottom portion 64*c* in a state that the lower flange 105 is placed on the bottom portion 64*c* of the bottom wall 64 of the housing 60. A small gap is defined between the lead end of the lower flange 105 and the stepped portion 64*d*. On the other hand, a lower end outer surface of the base portion 102 overlaps an upper end inner surface of the blade support plate 92.

The toner guide plate 100 substantially arranged in the housing 60 is disposed below the cleaning roller 70. Specifically, the cleaning blade 90 is arranged below the nip position i.e. a pressing contact position between the photosensitive drum 14 and the roller member 70B of the cleaning roller 70. The toner guide plate 100 extends from a position in proximity to the cleaning blade 90 toward the end wall 68 of the housing 60 beneath the roller member 70B. In other words, the toner guide plate 100 has a blade proximity portion in proximity to the cleaning blade 90. The blade proximity portion is constituted of the base portion 102 and the upper flange 104. The upper flange 104 extends horizontally and slightly upwardly from an inner position of the cleaning blade 90 beneath the nip position between the photosensitive drum 14 and the roller member 70B towards an area between the cleaning roller 70 and the spiral roller 72. The toner guide portion 106 continuing to the upper flange 104 is formed along the outer surface of the roller member 70B, with a certain gap with respect to the outer surface of the roller member 70B, in a region between the roller member 70B and the spiral roller 72. The toner guide portion 106 extends from a position below the roller member 70B to a region including a position substantially identical to the nip position in height, and opposing to the nip position with respect to the center of axis of the shaft 70A. With this arrangement, the lead end of the toner guide portion 106 is oriented upwardly.

In this embodiment, the upper end of the toner guide portion 106, and the nip position are located substantially on an unillustrated imaginary horizontal plane passing the center of axis of the shaft 70A of the cleaning roller 70. It is clear that a gap is defined between the toner guide portion 106, and the spiral segments 72B of the spiral roller 70. The spiral roller 72 is arranged at such a position that at least a part of the spiral segments 72B is located below a gap between the upper end of the toner guide portion 106 and the end wall 68 of the housing 60. The gap between the upper end of the toner guide portion 106, and the end wall 68 of the housing 60 serves as a toner falling passage P along which the toner residues conveyed along the gap between the roller member 70B and the toner guide portion 106 are allowed to fall.

As shown in FIG. 2, a drive gear 15 is arranged at the axial other end of the photosensitive drum 14 to be integrally rotatable with the photosensitive drum 14. The drive gear 15 is driven by an electric motor as an unillustrated drive source. An unillustrated driven gear is mounted on the shaft 70A of the cleaning roller 70 to be integrally rotatable with the shaft 70A. Also, an unillustrated driven gear is mounted on the shaft 72A of the spiral roller 72 to be integrally rotatable with the shaft 72A. The driven gear of the cleaning roller 70 is in mesh with the drive gear 15 of the photosensitive drum 14, and the driven gear of the spiral roller 72 is in mesh with the driven gear of the cleaning roller 70. The photosensitive drum 14 and the cleaning roller 70 are rotated in a downward direction at the nip position when the drive gear 15 is driven by the electric motor.

The driving control of the photosensitive drum 14 is described referring to FIG. 3. The photosensitive drum 14 is rotated clockwise in FIG. 3 by the electric motor. In response to the rotation of the photosensitive drum 14, the cleaning roller 70 is rotated counterclockwise, and the spiral roller 72 is rotated clockwise. The photosensitive drum 14 and the cleaning roller 70 are rotated in a downward direction at the pressing contact position i.e. the nip position.

As the photosensitive drum 14 is rotated, the roller member 70B of the cleaning roller 70 polishes the surface of the photosensitive drum 14, whereby toner residues on the surface of the photosensitive drum 14 are scraped into the housing 60. The cleaning blade 90 in pressing contact with the surface of the photosensitive drum 14 at a downstream position i.e. a lower position than the pressing contact position with the cleaning roller 70 scrapes the toner residues from the surface of the photosensitive drum 14 that have not been removed by the aforementioned operation of the roller member 70B of the cleaning roller 70, and the removed toner residues are allowed to fall into the housing 60.

The toner residues scraped from the surface of the photosensitive drum 14 are received on the upper flange 104 of the toner guide plate 100. The toner residues received on the upper flange 104 of the toner guide plate 100 are gradually deposited thereon. When the top surface of the deposited toner reaches the outer surface of the roller member 70B of the cleaning roller 70, part of the outer layer of the deposited toner is conveyed upwardly along the gap G between the outer surface of the roller member 70B and the toner guide portion 106 of the toner guide plate 100. During the conveyance, part of the toner conveyed along the gap G is adhered to the surface of the roller member 70B, and the adhered toner is supplied to the pressing contact position. Thus, the surface of the photosensitive drum 14 is sufficiently polished, as required.

Also, part of the toner residues is allowed to overflow through the gap G between the upper end of the toner guide plate 100 i.e. the upper end of the toner guide portion 106, and the roller member 70B, in other words, flows out of the exit of the toner container, and fall into the housing 60 along the toner falling passage P between the toner guide portion 106 and the end wall 68 of the housing 60. The remaining part of the toner residues falling into the housing 60 is carried to one axial end of the spiral roller 72 in accordance with rotation of the spiral roller 72, and is collected in an unillustrated toner collecting container.

Toner fluidity is generally lowered under a high-temperature, high-humidity condition, as compared with the normal environmental condition. Accordingly, toner overflowing from the gap G between the upper end of the toner guide plate 100 and the cleaning roller 70 may be deposited on the surface of the roller member 70B into a large mass, and the large mass of toner may fall into the toner falling passage P, without falling in a powdery state. The toner falling passage P may be relatively narrow, and the toner mass may have a larger size than the width of the toner falling passage P. Under the circumstance, the toner mass may clog the toner falling passage P, without passing through the toner falling passage P. If the toner falling passage P is clogged, circulation of toner near the cleaning blade 90 may be lowered, with the result that the toner may excessively stay around the cleaning blade 90. The excessive stay of the toner near the cleaning blade 90 may cause excessive charge of the toner. As a result, the surface of the photosensitive drum 14 may be discharged, which may damage the surface of the photosensitive drum 14.

As a result of investigating a cause of the aforementioned drawbacks, the inventors found that one of the reasons for the drawbacks is because the gap G between the upper end of the toner guide plate 100 and the cleaning roller 70 is larger than a proper value. Generally, the cleaning roller 70 is urged against the surface of the photosensitive drum 14 by the spring members, and therefore is in a constantly movable state. On the other hand, the cleaning blade 90 is fixed to the housing 60, and therefore is in a constantly stationary state. In this arrangement, it is difficult to accurately set the gap G to a proper value, and the gap G is resultantly set to a value larger than the proper value to avoid contact of the upper end of the toner guide plate 100 with the outer surface of the cleaning roller 70. If the gap G is set to a value larger than the proper value, merely the toner corresponding to the outer layer of the deposited toner is conveyed by the cleaning roller 70, and primary part of the toner in the gap G stays in the gap G without flowing. Consequently, if the gap G is larger than the proper value, the toner whose fluidity may be lowered is accumulated in the gap G, and an increased accumulation of the toner may cause the aforementioned drawbacks.

Unlike the aforementioned description, in the cleaning device 22 in accordance with the embodiment, the support flanges 108 (see FIG. 6) provided at the longitudinal both ends of the toner guide plate 100 i.e. in the axial direction of the photosensitive drum 14 are mounted on the shaft 70A of the cleaning roller 70. With this arrangement, despite that the roller member 70B of the cleaning roller 70 is resiliently contacted with the surface of the photosensitive drum 14, and that the position of the roller member 70B is movable, the upper end of the toner guide plate 100 i.e. the upper end of the toner guide portion 106 can follow the movement of the roller member 70B. This enables to stably maintain the gap G between the roller member 70B and the toner guide plate 100. Thus, the gap G can be accurately set to a proper value, and the thus set gap G can be stably maintained. Accordingly, toner fluidity within the gap G can be securely maintained, even if the toner fluidity is lowered under a high-temperature, high-humidity condition or a like condition. The above arrangement enables to suppress likelihood that the toner may be deposited at an upper part of the toner guide plate 100 into a large mass, and facilitates falling of the toner into the housing 60 along the toner falling passage P. Thus, circulation of the toner near the cleaning blade 90 is smoothly carried out, and excessive charging of the toner due to excessive stay of the toner near the cleaning blade 90 can be prevented.

In the cleaning device 22, the gap G is not smaller than 0.4 mm and not larger than 0.6 mm, and preferably 0.5 mm. As far as the gap G satisfies the requirement, occurrence of the aforementioned drawbacks can be suppressed.

In the cleaning device 22, pivotal movement of the toner guide plate 100 is restrained because the toner guide plate 100 is cooperatively supported by the blade support plate 92 and the housing 60. This enables to obtain the aforementioned effect more advantageously.

In the embodiment, the cleaning roller 70 is positioned relative to the photosensitive drum 14 in such a manner that the center of axis of the shaft 70A is located substantially on the unillustrated imaginary horizontal plane passing the center of axis of the shaft 14A of the photosensitive drum 14. The upper end of the toner guide portion 106 of the toner guide plate 100, and the pressing contact position are also located substantially on the aforementioned imaginary horizontal plane Alternatively, the layout of the individual components of the cleaning device 22 may be modified in such a manner that the center of axis of the shaft 70A of the cleaning roller 70 is located on an unillustrated imaginary tilted plane i.e. an unillustrated imaginary tilted plane passing the center of axis of the shaft 14A of the photosensitive drum 14, which is tilted upwardly or downwardly by a certain angle e.g. 300 or less with respect to the imaginary horizontal plane, when viewed from the axial direction of the cleaning roller 70.

In this embodiment, the printer with the cleaning device is described as an example to which the invention is applied. Alternatively, the invention may be applied to an image forming apparatus other than the printer e.g. an electrostatic copying machine, a laser printer, a facsimile machine, or a complex machine having the functions of the aforementioned devices.

The following is a summary of the embodiment.

In this embodiment, at least part of the toner scraped by the cleaning blade can be received on the toner guide plate. Also, the toner is allowed to flow in the gap defined by the toner guide portion and the cleaning roller. With this arrangement, the toner can be sufficiently adhered to the outer surface of the cleaning roller, thereby enabling to sufficiently polish the photosensitive drum.

Preferably, the photosensitive drum and the cleaning roller each may be rotated in a downward direction at the nip position between the cleaning roller and the photosensitive drum. This arrangement allows the cleaning blade to effectively scrape the toner that has not been scraped at the nip position.

Preferably, the cleaning roller may include a shaft and a roller member integrally rotated with the shaft, and the toner guide plate may be pivotally supported relative to the shaft of the cleaning roller. In other words, since the toner guide plate is supported on the shaft of the cleaning roller, the gap between the toner guide portion of the toner guide plate and the outer surface of the cleaning roller can be maintained at a certain value despite displacement of the roller member.

Preferably, the cleaning device may further comprise a blade support plate fixed to the housing, wherein the cleaning blade is fixed to the housing via the blade support plate, and the toner guide plate is supported by the blade support plate and the housing. With this arrangement, since the toner guide plate is cooperatively fixed by the blade support plate and the housing, pivotal movement of the toner guide plate can be substantially restricted during rotation of the cleaning roller. This arrangement enables to more stably maintain the gap between the toner guide plate and the roller member.

Preferably, the housing may include: two side walls opposing to each other in an axial direction of the photosensitive drum; a bottom wall extending between the side walls; a top wall extending between the side walls; an end wall extending between the side walls; and an opening formed in a position opposing to the end wall, and the cleaning roller may be operable to come into contact with the photosensitive drum through the opening.

Preferably, the blade proximity portion may include: a base portion having a predetermined height, and extending in an axial direction of the cleaning roller; and an upper flange formed between the base portion and the toner guide portion, and extending in the axial direction of the cleaning roller.

Preferably, the toner guide plate may include a pair of support flanges formed at longitudinal both ends of the upper flange, respectively, each of the support flanges may have an inner diameter slightly larger than an outer diameter of the shaft of the cleaning roller, a cross-sectional arc-shape corresponding to a semicircle or more than the semicircle, and a cross-sectionally arc-shaped support hole substantially opening toward the photosensitive drum, and the shaft of the cleaning roller may extend through the support holes of the support flanges.

Preferably, the upper flange may extend from a position corresponding to a certain position on an inner surface of the cleaning blade to a position below the cleaning roller, and the toner guide portion may extend from the upper flange to a position substantially identical to the nip position in height along the outer surface of the cleaning roller.

Preferably, the bottom wall of the housing may include an extension wall extending downwardly from a perimeter of the opening, and the blade support plate may include an upper end extending to a position above an inner surface of the bottom wall, and a lower end fixed to the extension wall.

Preferably, the bottom wall may include a bottom portion formed on an upper surface thereof, the bottom portion having a certain depth, and a predetermined width in a direction from a perimeter of the opening toward the end wall, the toner guide plate may include a lower flange laterally extending from a lower end of the base portion, the base portion may be fixed to the blade support plate, and the lower flange may be fixed to the bottom portion. This arrangement enables to enhance supportive rigidity of the toner guide plate.

Preferably, the blade support plate may have a certain height, and extend in an axial direction of the cleaning roller, and a lower end of the cleaning blade may be fixed to an upper end of the blade support plate.

Preferably, the gap between the outer surface of the cleaning roller and an upper end of the toner guide portion may be from 0.4 mm to 0.6 mm. In this arrangement, certain toner fluidity can be secured in the gap even under a condition that the toner fluidity is lowered. Accordingly, this arrangement enables to prevent excessive charging of toner resulting from deposition of the toner in the gap.

Another aspect of the invention provides an image forming apparatus including a photosensitive drum, and the cleaning device having the above arrangement.

This application is based on Japanese Patent Application No. 2006-291013 filed on Oct. 26, 2006, the contents of which are hereby incorporated by reference.

Although the invention has been appropriately and fully described by way of examples with reference to the accompanying drawings, it is to be understood that various changes and/or modifications will be apparent to those skilled in the art. Therefore, unless otherwise such changes and/or modifications depart from the scope of the present invention hereinafter defined, they should be construed as being included therein.

What is claimed is:

1. A cleaning device, comprising:

a housing;

a cleaning roller provided in the housing and operable to come into contact with a photosensitive drum at a nip position, the photosensitive drum and the cleaning roller are each rotated in a downward direction at the nip position;

a cleaning blade operable to come into contact with a surface of the photosensitive drum at a position lower than the nip position between the cleaning roller and the photosensitive drum; and a toner guide plate disposed below the cleaning roller, the toner guide plate including a blade proximity portion in proximity to the cleaning blade, and the toner guide portion extending along an outer surface of the cleaning roller spaced away from the outer surface of the cleaning roller by a predetermined gap.

2. An image forming apparatus, comprising:

the photosensitive drum; and the cleaning device of claim 1.

3. A cleaning device comprising:

a housing;

a cleaning roller provided in the housing and operable to come into contact with a photosensitive drum, the cleaning roller including a shaft, and a roller member integrally rotated with the shaft;

a cleaning blade operable to come into contact with a surface of the photosensitive drum at a position lower than a nip position between the cleaning roller and the photosensitive drum; and a toner guide plate disposed below the cleaning roller, the toner guide plate including a blade proximity portion in proximity to the cleaning blade, and a toner guide portion extending along an outer surface of the cleaning roller spaced away from the outer surface of the cleaning roller by a predetermined gap, the toner guide plate being pivotally supported relative to the shaft of the cleaning roller.

4. The cleaning device according to claim 3, wherein the photosensitive drum and the cleaning roller are each rotated in a downward direction at the nip position.

5. The cleaning device according to claim 3, further comprising:

a blade support plate fixed to the housing, wherein the cleaning blade is fixed to the housing via the blade support plate, and the toner guide plate is supported by the blade support plate and the housing.

6. The cleaning device according to claim 5, wherein the housing includes:

two side walls opposing to each other in an axial direction of the photosensitive drum;

a bottom wall extending between the side walls;

a top wall extending between the side walls;

an end wall extending between the side walls; and an opening formed in a position opposing to the end wall, and the cleaning roller is operable to come into contact with the photosensitive drum through the opening.

7. The cleaning device according to claim 6, wherein the blade proximity portion includes:

a base portion having a predetermined height, and extending in an axial direction of the cleaning roller; and an upper flange formed between the base portion and the toner guide portion, and extending in the axial direction of the cleaning roller.

8. The cleaning device according to claim 7, wherein the toner guide plate includes a pair of support flanges formed at longitudinal both ends of the upper flange, respectively, each of the support flanges has an inner diameter slightly larger than an outer diameter of the shaft of the cleaning roller, a cross-sectional arc-shape corresponding to a semicircle or more than the semicircle, and a cross-sectionally arc-shaped support hole substantially opening toward the photosensitive drum, and the shaft of the cleaning roller extends through the support holes of the support flanges.

9. The cleaning device according to claim 7, wherein the upper flange extends from a position corresponding to a certain position on an inner surface of the cleaning blade to a position below the cleaning roller, and the toner guide portion extends from the upper flange to a position substantially identical to the nip position in height along the outer surface of the cleaning roller.

10. The cleaning device according to claim 7, wherein the bottom wall includes a bottom portion formed on an upper surface thereof, the bottom portion having a certain depth, and a predetermined width in a direction from a perimeter of the opening toward the end wall, the toner guide plate includes a lower flange laterally extending from a lower end of the base portion, the base portion is fixed to the blade support plate, and the lower flange is fixed to the bottom portion.

11. The cleaning device according to claim 6, wherein the bottom wall of the housing includes an extension wall extending downwardly from a perimeter of the opening, and the blade support plate includes an upper end extending to a position above an inner surface of the bottom wall, and a lower end fixed to the extension wall.

12. The cleaning device according to claim 5, wherein the blade support plate has a certain height, and extends in an axial direction of the cleaning roller, and a lower end of the cleaning blade is fixed to an upper end of the blade support plate.

13. A cleaning device comprising:

a housing:

a cleaning roller provided in the housing and operable to come into contact with a photosensitive drum;

a cleaning blade operable to come into contact with a surface of the photosensitive drum at a position lower than a nip position between the cleaning roller and the photosensitive drum; and a toner guide plate disposed below the cleaning roller, the toner guide plate including a blade proximity portion in proximity to the cleaning blade, and a toner guide portion extending along an outer surface of the cleaning roller spaced away from the outer surface of the cleaning roller by a predetermined gap, wherein the gap between the outer surface of the cleaning roller and an upper end of the toner guide portion is from 0.4 mm to 0.6 mm.

* * * * *